US008944791B2

(12) United States Patent
Stone et al.

(10) Patent No.: US 8,944,791 B2
(45) Date of Patent: Feb. 3, 2015

(54) COMPRESSOR ASSEMBLY HAVING OIL SEPARATION FEATURE

(71) Applicant: Delphi Technologies, Inc., Troy, MI (US)

(72) Inventors: Scott F. Stone, Amherst, NY (US); John F. Quesada, Williamsville, NY (US); Ronald J. Vincent, East Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 212 days.

(21) Appl. No.: 13/633,547

(22) Filed: Oct. 2, 2012

(65) Prior Publication Data

US 2014/0093413 A1 Apr. 3, 2014

(51) Int. Cl.

| | |
|---|---|
| ***F03C 2/00*** | (2006.01) |
| ***F04C 2/00*** | (2006.01) |
| ***F04C 18/00*** | (2006.01) |

(52) U.S. Cl.

USPC ..... 418/55.6; 418/55.1; 418/55.4; 418/270; 418/DIG. 1

(58) Field of Classification Search

CPC .... F04C 18/0215; F04C 23/008; F04C 29/02; F04C 29/026; F04C 2240/809; F01C 1/0215; F01C 21/04

USPC ..... 418/88, 55.1–55.6, 57, 270, DIG. 1; 184/6.16–6.18

See application file for complete search history.

(56) References Cited

U.S. PATENT DOCUMENTS

| | | | | |
|---|---|---|---|---|
| 4,892,469 A * | 1/1990 | McCullough et al. | ..... | 418/55.6 |
| 5,346,376 A * | 9/1994 | Bookbinder et al. | ..... | 418/55.4 |
| 6,616,431 B2 * | 9/2003 | Kitano et al. | ..... | 418/55.6 |

FOREIGN PATENT DOCUMENTS

| | | | | |
|---|---|---|---|---|
| JP | 63150489 A * | 6/1988 | ..... | 418/55.6 |
| JP | 01285686 A * | 11/1989 | ..... | 418/55.6 |
| JP | 02095790 A * | 4/1990 | ..... | 418/55.6 |

* cited by examiner

*Primary Examiner* — Theresa Trieu
(74) *Attorney, Agent, or Firm* — James M. Chan

(57) ABSTRACT

A compressor assembly for compressing a working fluid and lubricated with an oil, including a housing having a suction plenum and a discharge plenum that defines a discharge chamber and an exhaust chamber in fluid communication through a discharge chamber outlet, and a compression mechanism disposed in the housing. A baffle member proximate the discharge chamber outlet and against which a compressed admixture of working fluid and oil expelled from the discharge chamber is impactable for separating oil from the impacting admixture. The baffle member has an oil-impingement surface for collecting oil separated from the impacting admixture and directing the flow of oil separated from the impacting admixture. Working fluid substantially at a discharge pressure and devoid of the oil collected on the oil-impingement surface is exhaustible from the exhaust chamber through the discharge port.

2 Claims, 4 Drawing Sheets

COMPRESSOR ASSEMBLY HAVING OIL SEPARATION FEATURE

BACKGROUND OF THE INVENTION

1. Field of the Invention

The present invention relates to a compressor assembly for use in an air conditioning system, and particularly to a compressor assembly for use in an automotive air conditioning system, and to features for separating oil and compressible working fluid within compressor assemblies.

2. Description of the Related Art

Compressor assemblies for automotive air conditioning systems are well-known in the art. A compressible working fluid such as a refrigerant gas is received into the compressor assembly housing at a suction pressure and discharged therefrom at a relatively higher discharge pressure. In automotive air conditioning systems, the compressor assembly typically has a drive shaft whose rotation axis is generally horizontal and that is driven by the engine crankshaft through a drive belt coupled to the engine crankshaft pulley, which serves as a rotative power source. The compressor drive shaft is coupled to a compression mechanism within the compressor housing. The compression mechanism of a scroll-type compressor assembly, for example, has an orbital scroll member coupled to the drive shaft and a nonorbital scroll member with which it is operably engaged. The orbital scroll member is driven in a generally circular orbit about the drive shaft rotation axis relative to the nonorbital scroll member.

In a scroll-type compressor assembly, the orbital scroll member includes a plate with a flat surface that is perpendicular to the rotation axis and an involute wrap integral with the plate and extending out from the flat surface. A cooperating nonorbital scroll member includes a plate with a flat surface that is parallel to the flat surface of the orbital scroll member, and an involute wrap integral with its plate that extends from its flat surface. The wraps and flat surfaces of the orbital and nonorbital scroll members cooperate to form fluid pockets which are bound by adjacent surfaces of the intermeshed wraps. These boundaries are established by line contacts between the intermeshed wraps, and contact between the axial tips of the intermeshed wraps and the flat surfaces of the scroll plates against which the wrap tips are slidably engaged. An example of a prior such scroll compressor assembly is described in U.S. Pat. No. 5,346,376 (Bookbinder et al.) issued Sep. 13, 1994, the disclosure of which is expressly incorporated herein by reference.

The working fluid at substantially suction pressure, and in which typically an amount of substantially incompressible lubricating oil is entrained, is received in a compression mechanism inlet between the scroll members, at a radially outward location. The received fluid/oil admixture is captured within the fluid pockets defined by the interengaged scroll wraps as the orbital scroll member moves about the shaft rotation axis relative to the nonorbital scroll member. The entrained oil lubricates and cools the interengaged scroll members. A seal is normally provided in a groove provided in the axial tip of each scroll wrap, to seal between the wrap and the flat surface of the adjacent scroll member plate against which it slides. The axial tip seals are provided to accommodate thermal expansion of the scroll members.

During operation, as the orbital scroll member is driven by the shaft, the contact lines and the fluid pockets defined between the intermeshed wraps move along the surfaces of the wraps toward the centers of the cooperating scroll members. The fluid pockets become smaller in volume as they move along the wraps toward the centers of the scroll members, and the working fluid in the pockets is compressed. Thus, the fluid pockets define fluid compression chambers in which the pressure of the contained fluid is raised from substantially suction pressure to a relatively higher, substantially discharge pressure. A fluid discharge aperture is provided near the center of the nonorbital scroll member, providing a passage through which the compressed fluid and oil mixture is expelled from the compression mechanism at substantially discharge pressure. The interengaged orbital and nonorbital scroll members thus define the compression mechanism.

Excess oil entrained in the refrigerant fluid collects on surfaces of heat exchangers in the refrigerant system, impairing system performance. It is therefore desirable that oil be retained within the compressor assembly for lubricating and cooling the compression mechanism and other moving parts within the compressor housing, rather than circulate with the working fluid through the remainder of the refrigeration system.

Oil separator apparatuses external to the compressor assembly are known which separate oil from compressed refrigerant fluid adjacently downstream of the compressor assembly in the refrigerant system, with the separated oil directed to a point adjacently upstream of the compressor assembly in the refrigerant system. The separated oil thus bypasses the heat exchangers of the system, through which is directed the working fluid from which the bypassing oil has been separated. Shortcomings of such external oil separation apparatuses include their attendant packaging requirements, additional costs, and an increased number of fluid joints at which external leaks could occur.

It would be beneficial if entrained lubricating oil were separated from the compressed fluid prior to the fluid's being exhausted from the compressor housing, and retained within the compressor housing. Such an improvement would promote enhanced heat exchanger performance and reduce the overall amount of oil necessary in the refrigerant system, while avoiding the shortcomings of external oil separation apparatuses.

SUMMARY OF THE INVENTION

The present invention provides the benefits of separating oil from the working fluid in a refrigerant system prior to directing the working fluid through the heat exchangers, and overcomes the shortcomings of prior, external oil separator apparatuses. Moreover, the present invention provides oil separation within the compressor assembly, the separated oil retained within the compressor housing.

A scroll-type compressor assembly according to the present invention, for example, includes a nonorbital scroll member and a cooperating, driven orbital scroll member mounted inside a housing. The scroll members include end plates with parallel flat surfaces and involute wraps which cooperate to form fluid pockets in which is received working fluid containing a quantity of entrained lubricating oil. The working fluid/oil admixture is received into the fluid pockets at substantially suction pressure and is compressed by the compression mechanism as the pocket volume decreases. An orbital scroll member drive assembly is journaled in the compressor housing for rotation about a drive shaft rotation axis, and is operably connected to the orbital scroll member. An anti-rotation mechanism prevents rotation of the orbital scroll member relative to the housing and permits its limited orbital movement relative to the nonorbital scroll member. As the drive assembly propels the orbital scroll member, the sealed fluid pockets move toward the centers of the cooperating scroll members. As the fluid pockets decrease in volume the fluid in the fluid pockets is compressed to relatively higher pressures. A fluid discharge aperture is provided near the center of the nonorbital scroll member for the passage of the compressed working fluid/oil admixture from between the interengaged scroll members at substantially discharge pressure, into a discharge chamber located in the housing.

The compressor housing includes a rear casing with a rear wall and side walls. The nonorbital scroll member and the rear casing cooperate to form the discharge chamber and a communicating exhaust chamber. The discharge chamber receives the compressed fluid/oil admixture from between the intermeshed scroll wraps at substantially discharge pressure. The rear casing and/or the nonorbital scroll member include continuous, generally C-shaped bosses which abut and act as side walls of the discharge chamber, and provide a discharge chamber outlet for the passage of compressed fluid into the exhaust chamber. A compressor discharge port is provided in the rear casing for the delivery of compressed fluid at a discharge pressure from the exhaust chamber.

A baffle member located in the exhaust chamber is radially aligned with the discharge chamber outlet, and has an oil-impingement surface. Compressed fluid/oil admixture exiting the discharge chamber outlet impacts the oil-impingement surface, and oil entrained in the fluid is separated from the impacting admixture and collected on the oil-impingement surface. The separated oil collected on the oil-impingement surface flows therealong and is received in an oil sump located vertically below the discharge chamber outlet, in the exhaust chamber. The compressor discharge port is in fluid communication with the exhaust chamber at a location vertically above the oil sump, and preferably also above the baffle member. Oil separated from the compressed fluid and received in the oil sump, which is under substantially discharge pressure, is returned to a location at substantially suction pressure within the housing and reintroduced to the compression mechanism and other moving components within the compressor housing. Compressed fluid from which oil has been separated is expelled from the exhaust chamber via the compressor discharge port.

The present invention provides a compressor assembly for compressing a working fluid and lubricated with an oil. The compressor assembly includes a housing having an interior surface, a suction port, a discharge port, a suction plenum for receiving working fluid substantially at a suction pressure through the suction port, and a discharge plenum. The discharge plenum is defining a discharge chamber having an outlet and an exhaust chamber in fluid communication with the discharge chamber through the discharge chamber outlet. A compression mechanism is disposed in the housing for compressing an admixture of working fluid and oil, and has a discharge aperture for passing a compressed admixture of working fluid and oil to the discharge chamber. A baffle member is proximate the discharge chamber outlet against which a compressed admixture of working fluid and oil expelled from the discharge chamber is impactable for separating oil from the impacting admixture. The baffle member has an oil-impingement surface for collecting oil separated from the impacting admixture and directing the flow of oil separated from the impacting admixture. The oil-impingement surface extends away from the discharge chamber outlet and toward the housing interior surface in the exhaust chamber. Working fluid substantially at a discharge pressure and devoid of the oil collected on the oil-impingement surface is exhaustible from the exhaust chamber through the discharge port.

The present invention further provides a compressor assembly for compressing a working fluid and lubricated with an oil, that includes a housing including a suction plenum and a discharge plenum, and a shaft supported by the housing and having a rotation axis that lies in a generally horizontal plane in an operating orientation of the compressor assembly. A compression mechanism for compressing an admixture of working fluid and oil is disposed in the housing and is operably coupled to the shaft. The suction and discharge plenums are axially separated by the compression mechanism. The discharge plenum defines a discharge chamber for receiving a compressed admixture of working fluid and oil from the compression mechanism and an exhaust chamber having a discharge sump in fluid communication with the suction plenum. The compressor assembly has a passage between the discharge and exhaust chambers that is located above the discharge sump in an operating orientation of the compressor assembly. A baffle member is located in the exhaust chamber and substantially aligned with the passage for being impacted by an admixture of working fluid and oil exiting the discharge chamber through the passage, whereby oil is separated from the admixture impacting the baffle member. The baffle member includes an oil-impingement surface for directing oil separated from the impacting admixture toward the discharge sump. The housing has a discharge port in fluid communication with the exhaust chamber for exhausting from the compressor assembly working fluid devoid of oil separated from the impacting admixture and directed by the oil-impingement surface toward the discharge sump.

There has thus been outlined, rather broadly, certain features of an exemplary embodiment of the invention in order that the detailed description thereof may be better understood, and in order that the present contribution to the art may be better appreciated. Additional or alternative features of an embodiment of the invention are described in further detail below.

Before explaining an embodiment of the invention in detail, however, it is to be understood that the invention is not limited in its application to the details of construction and to the arrangement of the components described above or set forth in the following detailed description of the best mode of practicing the invention illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The various objects, features and attendant advantages of the present invention will become fully appreciated as the same becomes better understood when considered in conjunction with the accompanying drawings. It is to be noted that the accompanying drawings are not necessarily drawn to scale or to the same scale; in particular, the scale of some of the elements of the drawings may be exaggerated to emphasize characteristics of the elements. Moreover, like reference characters designate the same, similar or corresponding parts throughout the several views, wherein.

Figure 1:
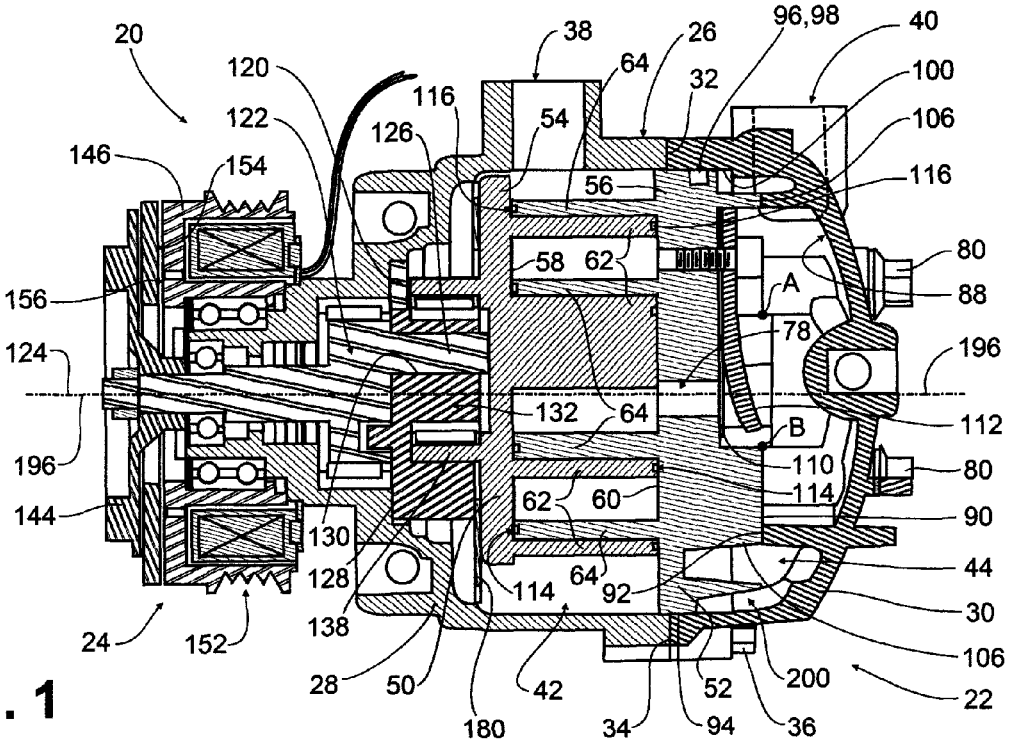
FIG. 1 is a partially cross-sectioned side view of an embodiment of a compressor and clutch assembly according to the present invention shown in an operating orientation.

The invention is susceptible to various modifications and alternative forms, and the specific embodiment thereof shown by way of example in the drawings is herein described in detail. It should be understood, however, that the drawings and detailed description are not intended to limit the invention to the particular form disclosed, but on the contrary, the intention is to cover all modifications, equivalents and alternatives falling within the spirit and scope of the present invention as defined by the appended claims.

DETAILED DESCRIPTION OF AN EXEMPLARY EMBODIMENT

Figure 2:
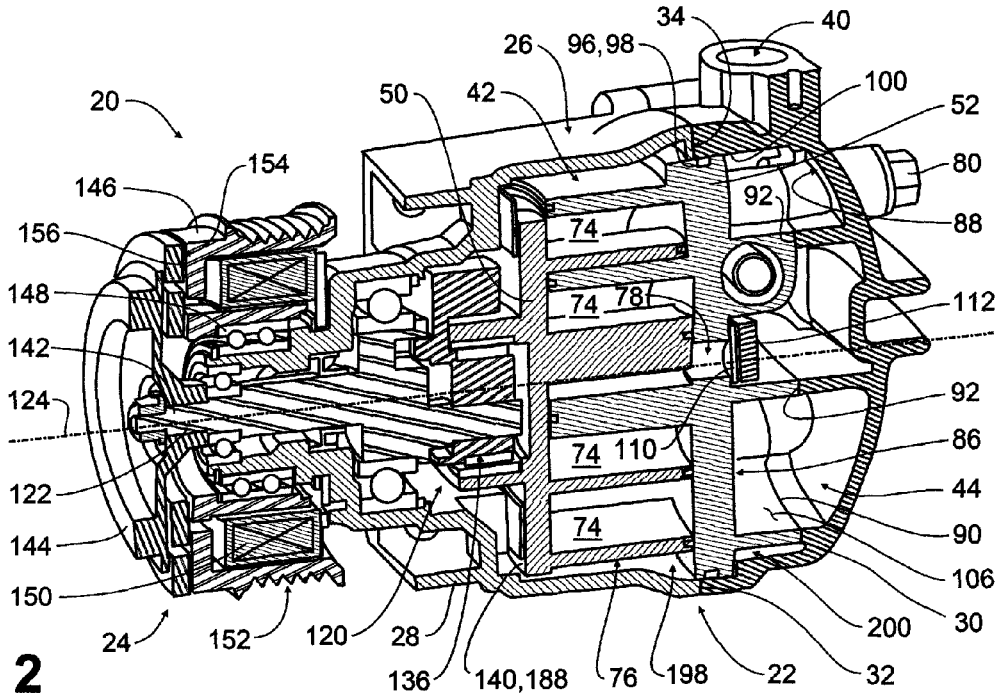
FIG. 2 is a cross-sectioned perspective view of the compressor and clutch assembly of FIG. 1.

The compressor and clutch assembly 20 shown in FIGS. 1 and 2 includes a scroll-type compressor assembly 22 and clutch assembly 24. Compressor assembly 22 includes a compressor housing 26 having inter-sealed front and rear casings 28 and 30 that are parts of the housing. The front and rear casings 28 and 30 are respectively provided with mating surfaces 32 and 34, and are affixed to each other by bolts 36 to define the housing 26. Views of the component rear casing 30 are provided in FIGS. 3 and 4. A compressor fluid inlet or suction port 38 and a compressor fluid outlet or discharge port 40 are provided in the housing 26. During compressor operation, a compressible working fluid, such as a refrigerant gas, at a suction pressure is received by the suction port 38, and is expelled a relatively higher, discharge pressure from the discharge port 40. The magnitudes of the suction and discharge pressures, and the differentials therebetween, vary considerably with different system operating conditions.

The compressor housing 26 is divided into a suction plenum 42 in fluid communication with the suction port 38, and a discharge plenum 44 in fluid communication with the discharge port 40. As used herein, "fluid communication" is understood to mean that the uninterrupted flow of a gas or liquid is facilitated between elements said to be in fluid communication.

Figure 7:
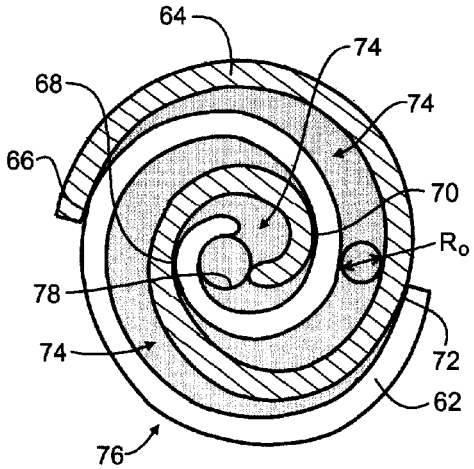
FIG. 7 is a partial, cross-sectioned front view of the interleaved orbital and nonorbital scroll members shown in FIG. 1.

An orbital scroll member 50 and a nonorbital scroll member 52 are interengaged and mounted within the housing 26. A view of the nonorbital scroll member 52 is provided in FIG. 5. A view of the orbital scroll member 50 is provided in FIG. 6. As best shown in FIG. 1, the scroll members 50 and 52 include end plates 54 and 56 with parallel, interfacing, flat surfaces 58 and 60, and involute wraps 62 and 64 extending therefrom, respectively. The involute wraps 62 and 64 are intermeshed and contact each other along contact lines 66, 68, 70 and 72 and the adjacent flat surfaces 58 and 60 to form closed fluid pockets or compression chambers 74 of variable volume, as shown in FIG. 7. The interengaged scroll members 50, 52 thus define a compression mechanism 76. Compressed fluid is expelled from the compression mechanism 76 via a passage 78, such as a discharge aperture 78, centrally located in the nonorbital scroll member 52.

Figure 8:
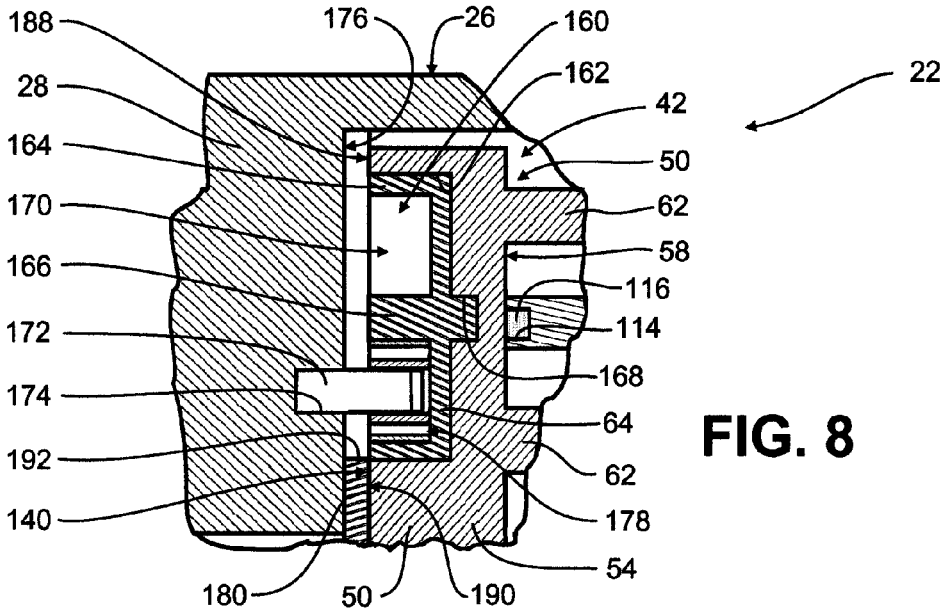
FIG. 8 is a fragmentary, cross-sectioned side view of the front casing and orbital scroll member, showing part of the anti-rotation mechanism of the compressor assembly.

As shown in FIGS. 1 and 8, tip seal grooves 114 may be provided in the scroll wraps 62, 64 with axial tip seals 116 provided that float therein. The tip seals 116 accommodate thermal expansion of the scroll wraps 62, 64 due to fluid temperature increases during fluid compression. The tip seals 116 also improve compressor efficiency, and accommodate the differences in thermal expansion between the radially inner portions of the involute wraps 62 and 64 where temperatures are highest during compressor operation and at their radially outer portions where temperatures are lowest during compressor operation. The tip seals 116 can also reduce wear and improve sealing between the axial tips of the involute wraps 62 and 64 and flat surfaces 58 and 60 on end plates 54 and 56.

Referring to FIGS. 1 through 5, within the housing 26, the nonorbital scroll member 52 is secured to the rear casing 30 with bolts 80 extending through clearance holes 82 in the rear casing 30 and threaded into corresponding blind, tapped holes 84 provided in the rear face 86 of the nonorbital scroll member 52, which is opposite the flat surface 60 of its end plate 54. The discharge plenum 44 is sealed relative to clearance holes 82. The nonorbital scroll member rear face 86 and the interfacing, interior surface 88 of the rear casing 30 are provided with axially projecting bosses which define abutment surfaces 90 and 92 brought into compressive engagement directly or through an intermediate gasket (not shown) when the bolts 80 are tightened.

The cylindrical outer peripheral surface 94 of the nonorbital scroll member 52 is provided with circumferential grooves 96 in which seals 98 are disposed, the seals 98 engaged with the mating, cylindrical, inner peripheral surface 100 of the rear casing 30 that radially interfaces nonorbital scroll member surface 94. Thus, the nonorbital scroll member 52 is fixed relative to the housing 26, and the nonorbital scroll member 52 partitions or separates the housing 26 into the suction plenum 42 and the discharge plenum 44, which are located on opposite axial sides of the nonorbital scroll member 52.

During compressor operation, the suction plenum 42 contains working fluid at substantially suction pressure and the discharge plenum 44 contains working fluid at substantially discharge pressure. The suction plenum 42 is in fluid communication with the compressor suction port 38 and the inlet to the compression mechanism 76, and the discharge plenum 44 is in fluid communication with the compressor discharge port 40. The fluid entering the inlet of the compression mechanism 76 is captured in the compression chambers 74 defined by the interleaved scroll members 50 and 52, compressed, and discharged from the compression mechanism 76 into the discharge plenum 44 via the passage or discharge aperture 78.

Figure 3:
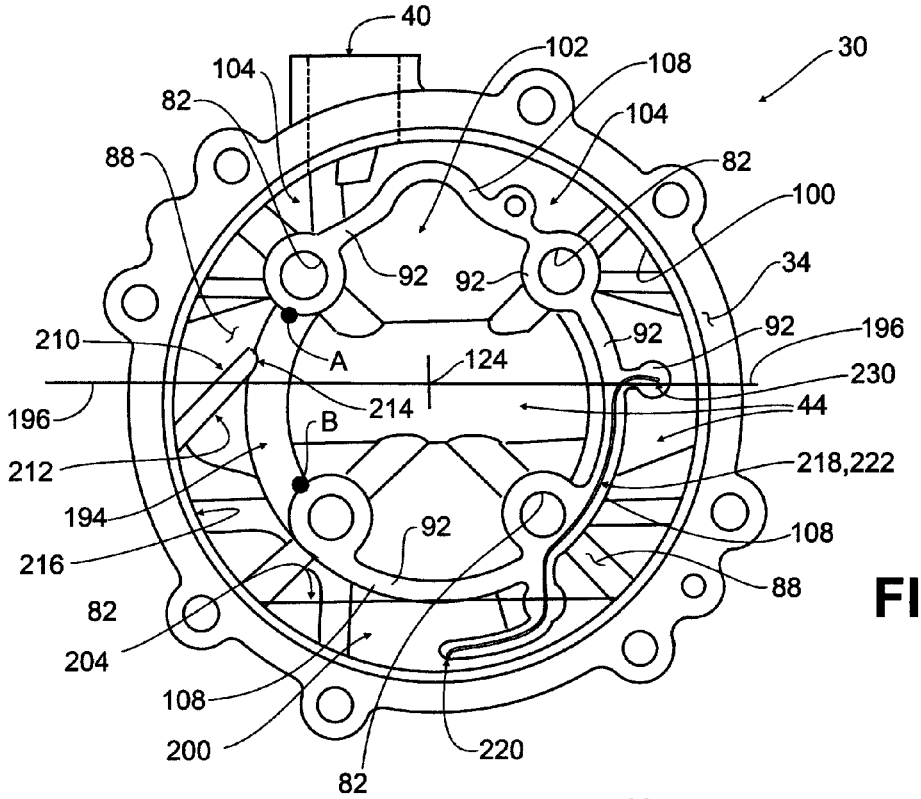
FIG. 3 is a front view of the rear casing of the compressor assembly shown in FIG. 1.
Figure 4:
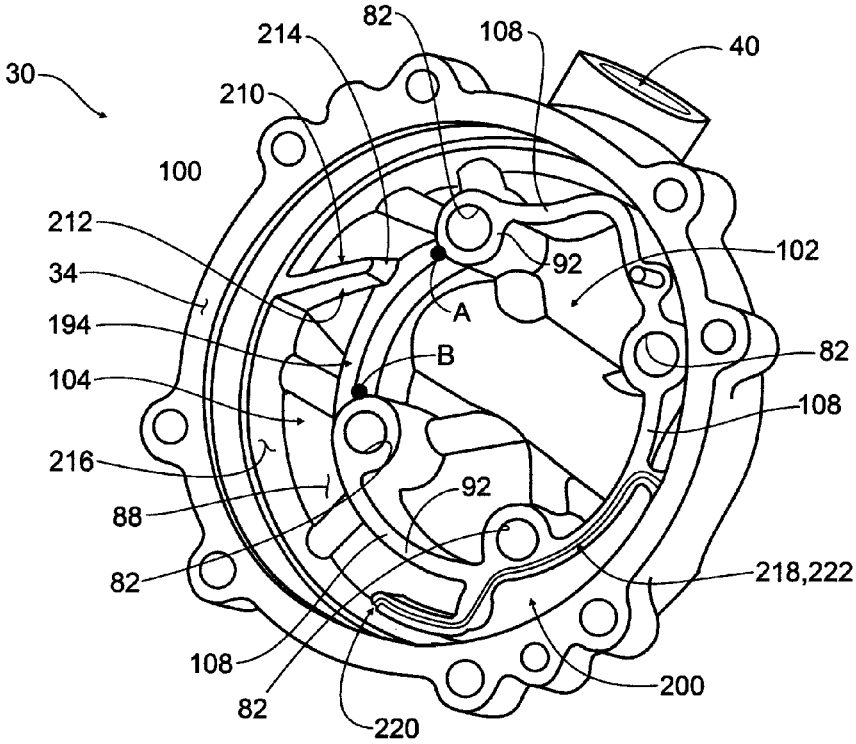
FIG. 4 is a front perspective view of the rear casing of FIG. 3.
Figure 5:
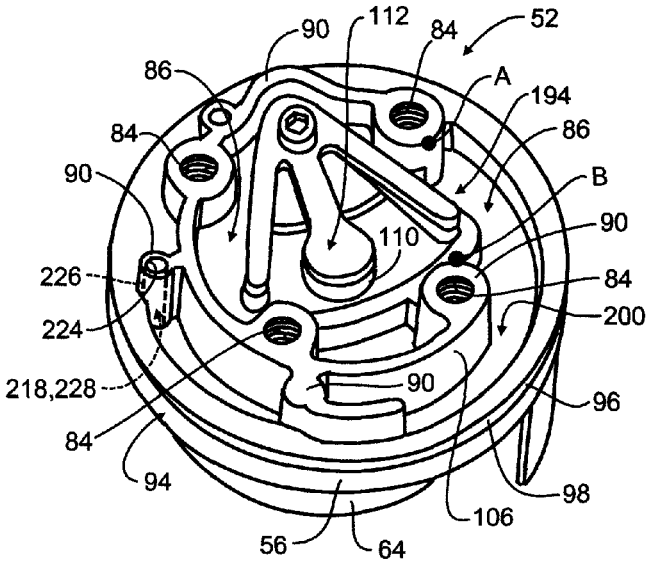
FIG. 5 is a rear perspective view of the nonorbital scroll member of the compressor assembly shown in FIG. 1.
Figure 6:
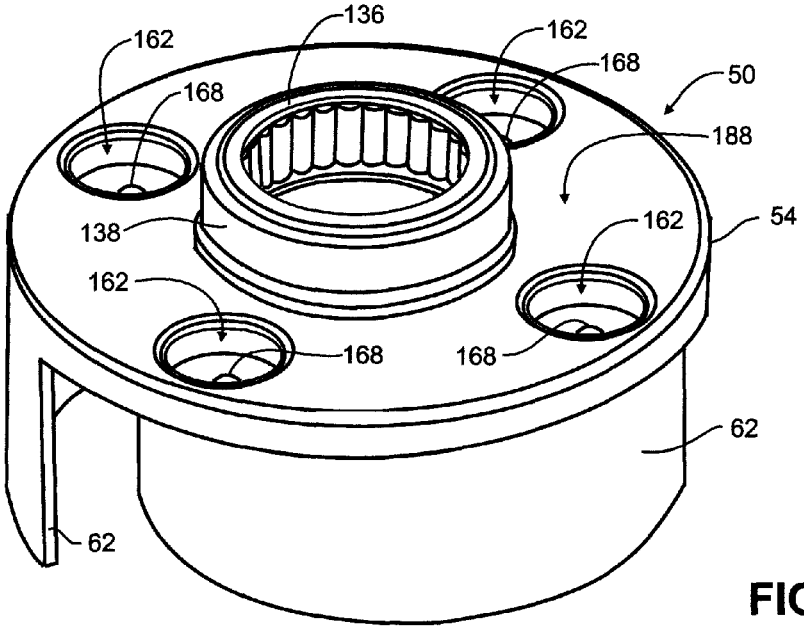
FIG. 6 is a front perspective view of the orbital scroll member of the compressor assembly shown in FIG. 1.

The discharge plenum 44 defines a discharge chamber 102 and a surrounding exhaust chamber 104. Referring to FIGS. 3 through 5, the axially projecting bosses of the rear face 86 of the nonorbital scroll member 52 and the front-facing interior surface 88 of the rear casing 30 define a mating pair of continuous, C-shaped wall portions 106 and 108 defining a wall that partially encloses the generally cylindrical discharge chamber 102. The C-shaped walls 106 and 108 axially abut directly or through an intermediate gasket (not shown). A reed-type check valve 110 is employed to prevent compressed fluid from flowing from the discharge plenum 44 back into the compression mechanism 76 through the passage or discharge aperture 78 in the nonorbital scroll member 52. In the depicted embodiment, the check valve 110 is mounted on the rear face 86 of the end plate 56 of the nonorbital scroll member 52. A ramped valve stop 112 attached to the nonorbital scroll member 52 limits movement of the check valve 110 in its open position. Alternatively, the valve stop 112 may be formed on a boss (not shown) projecting from the interior surface 88 of the rear casing 30 within the discharge chamber 102.

Figure 9:
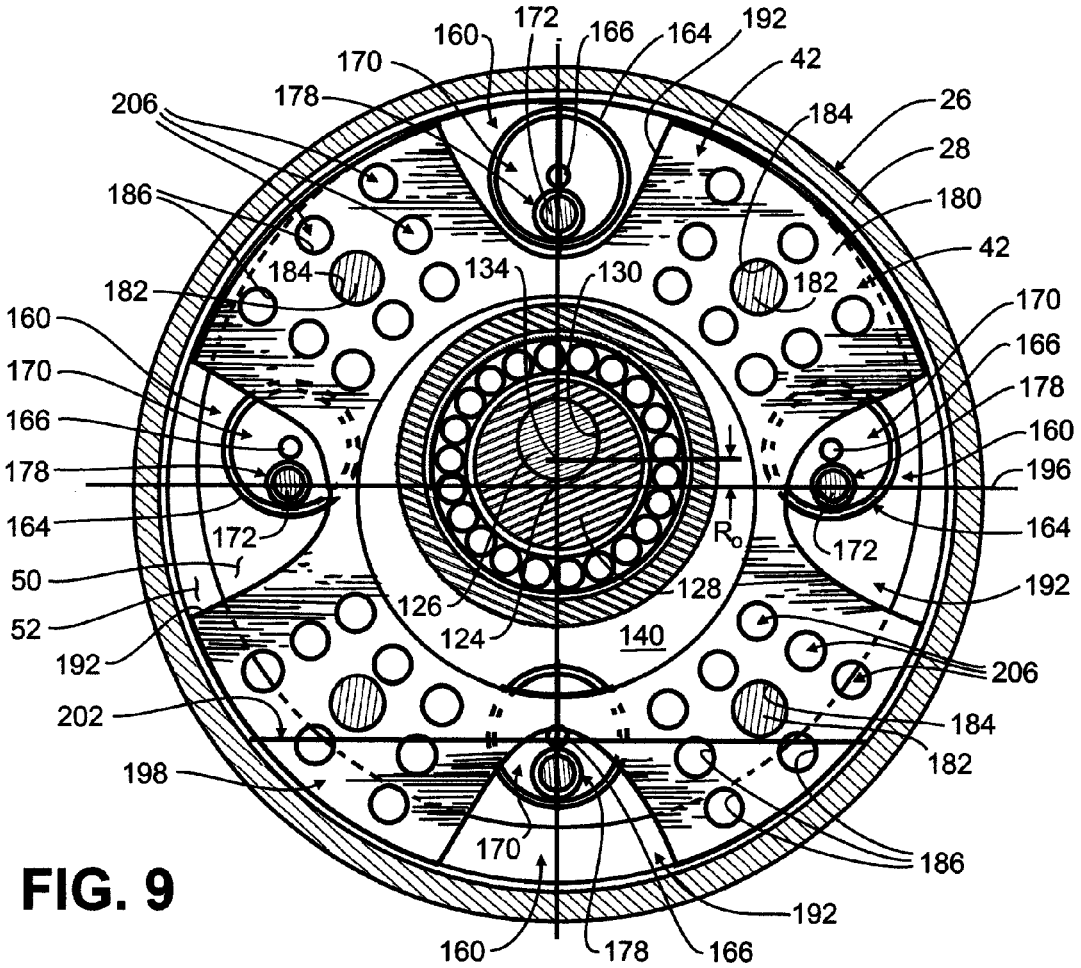
FIG. 9 is a partial, cross-sectioned front view of the compressor assembly in an operating orientation.

Referring again to FIGS. 1 and 2, the compressor assembly 22 has a scroll drive assembly 120 that includes a drive shaft 122, such as the depicted crankshaft 122, which is journaled in the front casing 28 for rotation about a shaft rotation axis 124. The crankshaft 122 has a cylindrical stub shaft portion 126 that is parallel with and revolves about the shaft rotation axis 124 at an orbit radius $R_o$, which is shown in FIGS. 7 and 9. A cylindrical, inertial balance weight 128 is mounted to the crankshaft 122, and has an axial through bore 130 into which the stub shaft portion 126 extends. The crankshaft 122 and the balance weight 128 are cooperatively interfitted such that the balance weight 128 rotates with the crankshaft 122. The outer cylindrical surface of the balance weight 128 defines an orbiting crank 132 having centerline or crank axis 134 that is offset from and orbits about the shaft rotation axis 124 by a distance equal to the radius of the orbit $R_o$ of the orbital scroll member 50. Crank 132 is received in, and is rotatably coupled via a bearing 136 to, a cylindrical hub 138 extending from the front face 140 of the orbital scroll member end plate 54 near its center. The cylindrical, central hub 138 is an integral part of the orbital scroll member 50, is located opposite its plate flat surface 58, and is concentric about crank axis 134. Rotation of the crankshaft 122 thus imparts orbital motion to the orbital scroll member 50.

Referring to FIGS. 1 and 2, the free end 142 of the crankshaft 122 extends forward, out of the suction plenum 42 through the front casing 28 so that it can be coupled to and driven by a rotative power source (not shown) through the clutch assembly 24. The crankshaft 122 and the front casing 28 are mutually sealed against refrigerant fluid and oil leakage from the compressor housing 26 by a shaft seal (not shown) disposed about the crankshaft 122 in a well-known manner.

In the depicted embodiment, the clutch assembly 24 includes a clutch hub assembly 144 rotatably fixed to the crankshaft free end 142, a pulley assembly 146 having a bearing 148 rotatably mounted to the front casing 28, and a selectively energizable electromagnetic coil assembly 150 affixed to the front casing 28. The toroidal coil assembly 150 is disposed about the pulley bearing 148 and surrounded by the sheave 152 of the pulley assembly 146. With the compressor and clutch assembly 20 operatively installed, the rotative power source (e.g., the engine crankshaft pulley, not shown) is continuously coupled to the pulley assembly 146 via a drive belt (not shown) that engages the pulley sheave 152. The clutch assembly 24 has a disengaged state in which the clutch hub assembly 144 is biased in a well-known manner into a position in which its rear-facing clutch surface 154 is spaced from the front-facing clutch surface 156 of the pulley assembly 146. When the coil assembly 150 is energized, the clutch assembly 24 is brought into its engaged state, in which the clutch surface 154 of the clutch hub assembly 144 is electromagnetically forced against the bias and into contact with the clutch surface 156 of the pulley assembly 146. In the engaged state of the clutch assembly 24, the interfacing clutch surfaces 154 and 156 are frictionally coupled for rotation in unison, thereby operably coupling the rotative power source and the compressor drive shaft 122 for driving the compression mechanism 76.

Referring to FIGS. 8 and 9, an anti-rotation mechanism 160 is mounted to and couples the front casing 28 and the orbital scroll member 50. The anti-rotation mechanism 160 prevents rotation of the orbital scroll member 50 relative to the housing 26 while allowing the orbital scroll member 50 to move orbitally relative to the nonorbital scroll member 52. The orbital scroll member 50 moves with the crank 132, about which its hub 138 is journaled, and thus relative to the nonorbital scroll member 52, in a circular orbit about the shaft rotation axis 124 at the orbit radius $R_o$, thereby defining, and then reducing the volume of, the compression chambers 74 as they move from the inlet to the compression mechanism 76 to the discharge aperture 78 thereof, as can be understood from review of FIG. 7.

As shown in FIGS. 8 and 9, the anti-rotation mechanism 160 includes a plurality of large, blind, first bores 162 in the orbital scroll member 50 that are spaced radially outboard of the hub 138 and open toward the front casing 28. In the depicted embodiment, four such first bores 162 are included that are circumferentially equidistantly spaced from each other about the orbiting scroll member hub 138 at a common radial distance from the hub's central crank axis 134. A cup 164 is pressed into each first bore 162 and a first pin 166 is pressed through an opening in the center of each cup 164 and into a blind second bore 168 concentric with the first bore 162 and having a relatively smaller diameter. Alternatively, each first pin 166 could be an integral part of its cup 164, as shown. The first pins 166 and the cups 164 cooperate to form a toroidal space or circular track 170 in each first bore 162.

Second pins 172 are pressed into mating, blind, third bores 174 in the planar rear surface 176 of the front casing 28. Each third bore 174 corresponds to one of the first bores 162 in the orbital scroll member 50. Optionally, a needle bearing 178 is pressed onto the end of each second pin 172 and is received in a respective circular track 170. Relative to the orbital scroll member 50, the second pin 172 and optional needle bearing 178 received within each first bore 162 orbit in a circle defined by the circular track 170 inside of its cup 164, and about its first pin 166. Thus, relative to the housing 26, the first pins 166 within the cups 164 move in circular orbits about the circumferences of the respective second pins 172 and, if present, their optional needle roller bearings 178 disposed in the circular tracks 170, these circular orbits each having a radius substantially equivalent to the orbit radius $R_o$ between the axes of the orbiting first pin 166 and the fixed second pin 172. The cylindrical inner surface of each cup 164 thus rides on the outer circumference of its respective second pin 172 or, if present, is optional needle roller bearing 178. The anti-rotation mechanism 160 prevents rotation of the orbital scroll member 50 relative to the housing 26 and allows orbital movement of the orbital scroll member 50 relative to the nonorbital scroll member 52. It can thus be understood that the anti-rotation mechanism 160 of the compressor assembly 22 is similar to that disclosed in above-mentioned U.S. Pat. No. 5,346,376, but is reversed as to which of the front casing and the orbital scroll member carry the cooperating cups and depicted needle bearings.

Referring to FIGS. 1, 2, 8, and 9, a thrust washer 180 is mounted on the rear surface 176 of the front casing 28. The thrust washer 180 is preferably made from a steel stamping and may be coated with a low friction material. Third pins 182, shown in cross-section in FIG. 9, are pressed through first apertures 184 in the thrust washer 180 and into mating, blind bores (not shown) in the rear surface 176 of the front casing 28, thereby fixing the position of the thrust washer 180 relative to the housing 26. In the depicted embodiment, the cooperating third pins 182, first apertures 184, and blind bores (not shown) of casing surface 176 are for maintaining the positional relationship between the thrust washer 180 and the housing 26. A plurality of second apertures 186 is optionally provided in the thrust washer 180. Optional second apertures 186 cooperate with the planar rear surface 176 of the front casing 28 to define a plurality of optional pockets 206 which are open towards the planar, front-facing surface 188 of the orbital scroll member front face 140. If present, optional pockets 206 contain quantities of the substantially incompressible oil that lubricate the sliding interface between the orbital scroll member 50 and the thrust washer 180. The sliding abutment between the flat surface 188 on the front face 140 of the orbital scroll member end plate 54, and the thrust washer 180, limits axial movement of the orbital scroll member 50 away from the nonorbital scroll member 52. The thrust washer 180 is provided with circumferentially-distributed notches 192 in which the second pins 172 and needle bearings 178 are disposed. It can thus be understood that the thrust washer 180 of the compressor assembly 22 is similar to that disclosed in above-mentioned U.S. Pat. No. 5,346,376.

Referring again to FIGS. 1 through 5, during compressor operation, compressed fluid at substantially discharge pressure and containing an entrained quantity of lubricating oil is expelled from the fluid pockets or compression chambers 74 of the compression mechanism 76 through the passage or discharge aperture 78 in the nonorbital scroll member 52, past discharge check valve 110, and into the discharge chamber 102. The compressed fluid and oil admixture flows from the discharge chamber 102 via a discharge chamber outlet or passage 194 located between the circumferential ends of the axially-stacked, C-shaped wall portions 106 and 108 that define the continuous side wall of the discharge chamber 102; these circumferential ends are indicated by points A and B in FIGS. 3 through 5, and the circumferentially elongate outlet 194 is located between them. Points A and points B of the rear casing 30 and nonorbital scroll member 52 respectively coincide when these components are assembled together, defining discharge plenum points A and B of the compressor assembly 22. The discharge and exhaust chambers 102 and 104 are in fluid communication with each other through the passage defined by the outlet 194 located between the discharge plenum points A and B.

Operatively installed, compressor assemblies used in automotive refrigeration systems typically have a belt-driven drive shaft that extends in a generally horizontal direction; i.e., they are known as horizontal compressor assemblies. In its preferred mounting configuration and operating orientation, the shaft rotation axis 124 of the compressor assembly 22 is generally horizontal, and lies in a generally horizontal plane 196, shown in FIGS. 1, 3, and 9. Further, the operating orientation of the compressor assembly 22 positions the discharge chamber outlet or passage 194 such that the horizontal plane 196 is preferably positioned between discharge plenum points A and B; in other words, the plane 196 is preferably positioned within the passage 194 between the discharge and exhaust chambers 102, 104 defined by this outlet, as shown in FIG. 3. Moreover, the discharge port 40 is preferably positioned vertically above the generally horizontal plane 196.

Oil sumps 198 and 200 are respectively located in the suction and discharge plenums 42 and 44. The oil sump 198 located in the suction plenum 42 and the oil sump 200 located in the discharge plenum 44 are also referred to herein as the suction sump 198 and the discharge sump 200, respectively. The respective oil surface levels 202 and 204 of these oil sumps are both normally located vertically below the horizontal plane 196 during compressor operation, as indicated in FIGS. 9 and 3. Those of ordinary skill in the art will recognize that during compressor operation the oil deposited in the suction sump 198 is under substantially suction pressure, and the oil deposited in the discharge sump 200 is under relatively higher substantially discharge pressure.

Referring to FIGS. 3 and 4, a baffle member 210 is disposed in the exhaust chamber 104, the baffle member 210 substantially radially aligned with and proximate the discharge chamber outlet 194. In other words, the baffle member is circumferentially located in the exhaust chamber 104 substantially between discharge plenum points A and B. As shown in FIG. 3, in the operating orientation of the compressor assembly 22, the baffle member 210 is positioned in the horizontal plane 196. It is to be understood, however, that the baffle member 210 may instead be positioned slightly below the horizontal plane 196 and still be substantially radially aligned with the discharge chamber outlet 194. During compressor operation, the compressed working fluid/oil admixture exiting the discharge chamber 102 through its outlet 194 impacts the baffle member 210, whereby oil is separated from the admixture. The baffle member 210 has an oil-impingement surface 212 that generally faces towards the discharge chamber outlet 194, and may itself be impacted by the admixture being expelled from the discharge chamber 102. The oil caused to be separated from the working fluid as a result of the admixture impacting the baffle member 210 is collected on the oil-impingement surface 212, and the separated oil deposited on the oil-impingement surface 212 tends to flow therealong, away from the discharge chamber outlet 194.

In the depicted embodiment, with the compressor assembly 22 mounted horizontally as described above, the oil-impingement surface 212 is directed downwardly, and radially outwardly relative to the shaft rotation axis 124, from a leading, terminal end or edge 214 towards a radially outer side surface 216 of the exhaust chamber 104. As shown in FIG. 3, the oil-impingement surface 212 may extend through the generally horizontal plane 196, with its leading edge 214 located above the plane. Further, the leading edge 214 of the oil-impingement surface 212 may be elongate as shown, extending generally axially, i.e., generally parallel with shaft rotation axis 124, in a direction between the rear face 86 of the nonorbital scroll member 52 and the interfacing, front-facing interior surface 88 of the rear casing 30. Thus, the terminal end 214 of the oil-impingement surface 212 may traverse all or a portion of the axial width of the opening of the discharge chamber outlet 194; substantially the entire oil-impingement surface 212 may be exposed to the outlet 194 obliquely. So configured, fluid/oil admixture expelled from the discharge chamber 102 through outlet or passage 194 impacts the baffle member 210 directly on its oil-impingement surface 212, thereby depositing a film of oil on the oil-impingement surface 212. The deposited film of separated oil collecting on the oil-impingement surface 212 flows along it toward the exhaust chamber side surface 216 and the discharge sump 200 in which the separated oil is received.

As shown in FIGS. 3 and 4, the baffle member 210 may be integral with the radially outer, interior sidewall of the rear casing 30, with the trailing end of the oil-impingement surface 212 opposite its leading edge 214 merging into the interior side surface 216 of the exhaust chamber 104. Alternatively, the baffle member 210 may be integral with the rear face 86 of the nonorbital scroll member 52, with the trailing end of the surface 212 opposite its leading edge 214 positioned adjacent the exhaust chamber interior side surface 216. The oil-impingement surface 212 may be substantially planar, as shown; the baffle member 210 itself may also be substantially planar, as shown.

During compressor operation, oil entrained in the compressed working fluid exiting the discharge chamber 102 is impacted upon the baffle member 210, thereby separating oil from the admixture. The separated oil collects on the oil-impingement surface 212 as a result of impacting the baffle member 210, and flows downwardly and radially outwardly along the oil-impingement surface 212, away from the leading edge 214 under the force of gravity. The oil on the surface 212 may also be blown therealong by the compressed fluid exiting the discharge chamber 102. Separated oil collected on the oil-impingement surface 212 is directed towards the interior side surface 216 of the exhaust chamber 104, and then flows downwardly along the exhaust chamber side surface 216 and into the discharge oil sump 200. The compressed working fluid, which may still contain a minimal quantity of entrained oil but which is devoid of the oil collected on the oil-impingement surface 212, is expelled from the exhaust chamber 104 at a discharge pressure through the discharge port 40. Thus, at least a portion of the oil entrained in the compressed fluid of the admixture received in the discharge chamber 102, is separated from the admixture before the compressed fluid from which it has been separated, is exhausted from the compressor assembly 22 through the discharge port 40. Compressed working fluid from which oil has been separated, and exhausted at a discharge pressure from the compressor assembly 22 through the discharge port 40, is directed to the remainder of the refrigerant system (not shown), thereby minimizing the quantity of oil introduced to its heat exchangers. This fluid is returned to the compressor assembly 22 at a suction pressure through the suction port 38, which opens into the suction plenum 42.

Lubricating oil collected in the discharge sump 200 and under substantially discharge pressure is conveyed from the discharge sump 200 to the suction plenum 42 through an oil return conduit 218, by which the discharge plenum 44 and suction plenum 42 are in fluid communication internally of the compressor assembly 22. During compressor operation, oil flow through the oil return conduit 218 is continuous, but metered by the length and/or a cross-sectional size of the conduit 218. The oil flow through the oil return conduit 218 is urged by the pressure differential between the suction and discharge plenums 42 and 44, i.e., between substantially discharge and substantially suction pressures. The oil return conduit 218 has an inlet 220 opening into the discharge sump 200 at a location normally below the surface level 204 of the oil pooled therein, and a first leg or conduit portion 222 that extends from the inlet 220 to the entrance of an oil return bore 226 extending axially through the nonorbital scroll member 52. The oil return bore 226 defines a second leg or portion 228 of the oil return conduit 218 that has a minimal cross-sectional size which is larger than that of the conduit first leg 222.

The first leg 222 of the oil return conduit 218 may be defined by a groove formed in one or the other, or both, of a pair of abutting axial surfaces 90, 92 of bosses projecting from the rear face 86 of the nonorbital scroll member 52 and the interfacing interior surface 88 of the rear casing 30. Alternatively, the first leg 222 of the oil return conduit 218 may be defined by an elongate slot extending through the axial thickness of a gasket (not shown) sandwiched between the pair of abutting axial surfaces 90, 92 of these abutting bosses. Alternatively, the first leg 222 may be defined by one or a plurality of intersecting bores (not shown) extending through one of these abutting bosses. In the depicted embodiment, a first leg-defining groove 222 is formed in portions of the axial abutment surface 92 of a boss projecting from the interior surface 88 of the rear casing 30, as shown in FIGS. 3 and 4.

Referring to FIG. 5, the entrance 224 to the oil return bore 226 located in a portion of the abutment surface 90 of the nonorbital scroll member 52 is superposed by a portion of the abutment surface 92 of the rear casing 30 in which the conduit first leg groove 222 is formed (FIG. 3), and is in fluid communication with the end 230 of the oil return conduit first leg 222. Thus, the oil return conduit 218 is sealed from the discharge plenum 44 at the juncture between the oil return conduit first and second legs 222, 228. The exit (not shown) of the oil return bore 226, which is located axially opposite its entrance 224 is open to the suction plenum 42 at a location normally above the oil surface level 202 of the suction plenum 198. Oil received into the suction plenum 42 via the oil return conduit 218 tends to flow toward the suction sump 198, in which it collects at substantially suction pressure. Oil separated from the working fluid by the compressed admixture impacting the baffle member 210 and received in the discharge sump 200, is thus drawn or forced through the oil return conduit 218 from the discharge plenum 44 to the suction plenum 42 by the pressure differential therebetween, and is retained within the compressor assembly 22. A portion of the oil received in the suction plenum 42 via the oil return conduit 218 is admixed with working fluid at substantially suction pressure received therein through the suction port 38, and the fluid/oil admixture is drawn into the inlet of the compression mechanism 76.

The oil disposed in the suction sump 198 that does not become admixed with working fluid in the suction plenum 42 may be distributed within the suction plenum 42. This oil may be distributed by being sloshed, or splashed or carried by the orbital scroll member 50 as it moves in its circular orbit about shaft rotation axis 124, and become disposed on and between surfaces in the suction plenum 42 and in the oil pockets 206. A portion of the oil that has become entrained in the working fluid may also be separated from the fluid/oil admixture by contacting surfaces in the suction plenum 42 before the admixture is drawn into the compression mechanism 76.

The foregoing description of the best mode for carrying out the invention is considered as illustrative of principles of the invention. It will be understood by those of ordinary skill in the art that modifications to the described embodiment can be made that are within the scope of the invention.

As to a further discussion of the manner of usage and operation of the present invention, the same should be apparent from the above description. With respect to the above description then, it is to be realized that the optimum dimensional relationships for the parts of the invention, to include variations in size, materials, shape, form, function and manner of operation, assembly and use, are deemed readily apparent and obvious to those of ordinary skill in the art, and all equivalent relationships to those illustrated in the drawings and described in the specification are intended to be encompassed by the present invention.

What is claimed is:

1. A compressor assembly for compressing a working fluid and lubricated with an oil, said compressor assembly comprising:

a housing having an interior surface, a suction port, a discharge port, a suction plenum for receiving working fluid at a suction pressure through said suction port, and a discharge plenum defining a discharge chamber having an outlet and an exhaust chamber in fluid communication with said discharge chamber through said discharge chamber outlet;

a compression mechanism disposed in said housing for compressing an admixture of working fluid and oil, said compression mechanism having a discharge aperture for passing a compressed admixture of working fluid and oil to said discharge chamber;

a baffle member proximate said discharge chamber outlet and against which a compressed admixture of working fluid and oil expelled from said discharge chamber is impactable for separating oil from the impacting admixture, said baffle member having an oil-impingement surface for collecting oil separated from the impacting admixture and directing the flow of oil separated from the impacting admixture, said oil-impingement surface extending away from said discharge chamber outlet and toward said housing interior surface in said exhaust chamber;

wherein working fluid at a discharge pressure and devoid of the oil collected on said oil-impingement surface is exhaustible from said exhaust chamber through said discharge port;

wherein said discharge chamber outlet and said baffle member are aligned with each other;

wherein said discharge and exhaust chambers are separated by a wall extending between said housing and said compression mechanism and having spaced ends, said discharge chamber outlet located between said spaced wall ends.

2. The compressor assembly of claim 1, wherein said compressor assembly defines a plane located between said spaced wall ends.

* * * * *